US008302555B2

(12) United States Patent
Nakazawa et al.

(10) Patent No.: US 8,302,555 B2
(45) Date of Patent: Nov. 6, 2012

(54) LIQUID COATING APPARATUS AND METHOD, AND IMAGE FORMING APPARATUS

(75) Inventors: Yusuke Nakazawa, Kanagawa-ken (JP); Toshiyuki Makuta, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 596 days.

(21) Appl. No.: 12/412,106

(22) Filed: Mar. 26, 2009

(65) Prior Publication Data

US 2009/0246396 A1 Oct. 1, 2009

(30) Foreign Application Priority Data

Mar. 27, 2008 (JP) ..... 2008-084486

(51) Int. Cl.

| | |
|---|---|
| ***B05C 1/06*** | (2006.01) |
| ***B05C 1/08*** | (2006.01) |
| ***B05C 11/00*** | (2006.01) |
| ***B41J 2/01*** | (2006.01) |

(52) U.S. Cl. ..... 118/262; 118/256; 118/258; 118/663; 118/668; 118/669; 118/673; 347/101; 347/103

(58) Field of Classification Search ..... None
See application file for complete search history.

(56) References Cited

U.S. PATENT DOCUMENTS

| | | | | |
|---|---|---|---|---|
| 5,759,278 | A * | 6/1998 | Tomono et al. | 118/681 |
| 2005/0178324 | A1 * | 8/2005 | Iwasaki et al. | 118/244 |
| 2007/0035592 | A1 | 2/2007 | Oshio et al. | |

FOREIGN PATENT DOCUMENTS

| | | | |
|---|---|---|---|
| JP | 09-073255 | A | 3/1997 |
| JP | 2006-142665 | A | 6/2006 |
| JP | 2007-050315 | A | 3/2007 |
| JP | 2007-83180 | A | 4/2007 |
| JP | 2007-301817 | A | 11/2007 |

OTHER PUBLICATIONS

Japanese Office Action for corresponding Application No. JP 2008-084486 dated Jun. 8, 2012 and English-Language translation thereof.

* cited by examiner

*Primary Examiner* — Dah-Wei Yuan
*Assistant Examiner* — Binu Thomas
(74) *Attorney, Agent, or Firm* — Birch, Stewart, Kolasch & Birch, LLP

(57) ABSTRACT

A liquid coating apparatus has: a coating roller which has a coating surface; a liquid holding unit which abuts against the coating surface of the coating roller so as to form a liquid holding space; a medium support member which faces the coating surface in such a manner that the medium support member and the coating roller nip and support the medium; an abutment pressure-varying device which adjusts at least one of a first abutment pressure between the coating surface of the coating roller and the liquid holding unit and a second abutment pressure between the coating surface of the coating roller and the medium; and a control device which controls the abutment pressure-varying device according to a relative position of the medium with respect to the coating roller, wherein the coating roller rotates while the medium is sandwiched by the medium support member and the coating roller in such a manner that the liquid is fed to the coating surface from the liquid holding unit and the liquid is transferred to the medium from the coating surface.

12 Claims, 9 Drawing Sheets

LIQUID COATING APPARATUS AND METHOD, AND IMAGE FORMING APPARATUS

BACKGROUND OF THE INVENTION

1. Field of the Invention

The present invention relates to a liquid coating apparatus, a liquid coating method and an image forming apparatus, and more particularly to liquid application technology which is suitable as a device for depositing a treatment liquid on a recording medium with the object of promoting aggregation of coloring material or the like, prior to ejecting ink droplets in an inkjet recording apparatus, and to an image forming apparatus which uses this technology.

2. Description of the Related Art

In order to achieve higher image quality for the printed image in the field of inkjet recording apparatuses, the use has recently become known of a liquid coating mechanism that applies a coating liquid (treatment liquid) that induces aggregation of the ink colorants on the surface of the printed medium; this application is carried out prior to the application of the inkjet image. A liquid coating mechanism is disclosed in Japanese Patent Application Publication No. 2007-83180 that takes into account the coatability on target media (recording media) that have a relatively small size, e.g., sheet-form paper, as well as the prevention of liquid leakage due to changes in position during transport by the apparatus. This liquid coating mechanism is provided with a coating roller that rotates in contact with the recording medium and a liquid holding member that holds the coating liquid in a liquid holding space that is formed with the roller surface by abutment with the circumference (coating surface) of the coating roller.

The liquid coating apparatus described in Japanese Patent Application Publication No. 2007-83180 has a structure in which, through rotation of the coating roller, coating liquid is transferred onto the recording medium from the coating medium while coating liquid is also fed to the coating surface of the coating roller from the liquid holding space.

However, in the liquid coating apparatus disclosed in Japanese Patent Application Publication No. 2007-83180, the coating surface of the roller comes into direct contact with the backup roller (the backup roller is positioned on the back surface of the paper sheet) between one paper sheet and the ensuing paper sheet, which results in contamination of the apparatus and in extreme cases produces leakage by the liquid and may also result in contamination of the back surface of the paper sheet by retransfer of the treatment liquid from the backup roller.

In addition, while the formation of a liquid puddle (known as a bead) between a medium (sheet-form paper) and a coating roller enables the elaboration of a uniform coating at a prescribed film thickness in a coating step that uses a coating roller, this liquid bead is unstable in the case of the leading edge region of intermittently fed paper sheet, making uniform coating quite problematic.

SUMMARY OF THE INVENTION

The present invention has been contrived in view of the circumstances described above. An object of the present invention is to provide a liquid coating apparatus and a liquid coating method that are able to solve problems that are derived from coating intermittently fed recording media and execute a uniform coating in a desired thickness on various types of sheet-form recording media (sheet-form paper). A further object of the present invention is to provide an image-forming apparatus that uses this liquid coating apparatus/method and enables the recording of an image at high image qualities.

A liquid coating apparatus comprising: a coating roller which has a coating surface applying a liquid onto a sheet-form medium; a liquid holding unit which abuts against the coating surface of the coating roller so as to form a liquid holding space from which the liquid is fed to the coating surface; a medium support member which faces the coating surface of the coating roller across the medium in such a manner that the medium support member and the coating roller nip and support the medium; an abutment pressure-varying device which adjusts at least one of a first abutment pressure exerted between the coating surface of the coating roller and the liquid holding unit and a second abutment pressure exerted between the coating surface of the coating roller and the medium; and a control device which controls the abutment pressure-varying device according to a relative position of the medium with respect to the coating roller so as to adjust the at least one of the first abutment pressure and the second abutment pressure, wherein the coating roller rotates while the medium is sandwiched by the medium support member and the coating roller in such a manner that the liquid is fed to the coating surface from the liquid holding unit and the liquid is transferred to the medium from the coating surface.

According to this aspect of the invention, through the control—before and after the interruption in medium traverse—of at least one of the first abutment pressure and the second abutment pressure, perturbations in the liquid bead at the commencement of coating are extinguished, thereby enabling uniform coating on the medium. In addition, the amount of coating liquid transfer to the medium support member from the coating roller when coating is finished can be reduced and contamination of the medium support member can be limited.

Here, a "medium" is a general term for a medium which receives the application of liquid, and this term includes, for instance, a so-called print medium in an inkjet recording apparatus, an image forming medium, recording medium, image receiving medium, ejection receiving medium, intermediate transfer body, and the like. There are no particular restrictions on the shape or material of the medium, which may be various types of media, irrespective of material and size, such as continuous paper, cut paper, sealed paper, resin sheets, such as OHP sheets, film, cloth, a printed circuit substrate on which a wiring pattern, or the like, is formed, a rubber sheet, a metal sheet, or the like.

The "medium support member" can be configured as a backup roller, belt, a flat plate-like member, and so forth, wherein a backup roller is particularly preferred.

The second abutment pressure correlates with the contact nip width of the medium-contacting coating roller, and as a consequence control of the second abutment pressure within the context of this aspect of the invention encompasses control of the contact nip width.

Desirably, the liquid holding unit has an abutment member which is formed from an elastic body and is disposed in a region of contact with the coating surface of the coating roller.

This abutment member functions as a sealing member that is deformed by the pressing pressure (first abutment pressure) and thereby seals the liquid holding space of the liquid holding unit.

Desirably, the abutment pressure-varying device has a movable mechanism that presses the liquid holding unit toward the coating surface of the coating roller.

A movable mechanism that displaces the liquid holding unit toward or away from the coating surface of the coating roller can be used as a device that increases or reduces the pressing pressure by the liquid holding unit against the coating surface of the coating roller.

Desirably, the movable mechanism includes: an urging member that urges the liquid holding unit toward the coating surface of the coating roller; and a cam that changes an amount of deformation of the urging member.

This embodiment can secure a constant abutment pressure even as the abutment region of the liquid holding unit undergoes wear, and can be realized at low cost.

Desirably, the abutment pressure-varying device is a displacement device that is able to displace the coating roller in a direction corresponding to a direction in which the coating roller is separated from the medium, and in a direction corresponding to a direction in which the coating roller is pressed toward the medium.

By structuring the coating roller to be displaceable toward and displaceable away from the medium, the relative positional relationship among the medium, coating roller, and liquid holding unit can be changed. For example, by displacing the axle of the coating roller in a direction away from the medium, the second abutment pressure can be lessened and the abutment pressure between the coating roller and the liquid holding unit (the first abutment pressure) can be strengthened.

Desirably, when the displacement device displaces the coating roller in the direction corresponding to the direction in which the coating roller is separated from the medium, a pressing pressure between the coating roller and a coating roller-abutting downstream region of the liquid holding unit on a downstream side in terms of a direction in which the coating roller rotates is increased while a pressing pressure between the coating roller and a coating roller-abutting upstream region of the liquid holding unit on an upstream side in terms of the direction in which the coating roller rotates is reduced.

This embodiment limits feed of the liquid by increasing the pressing pressure in an abutment region on the feed side (abutment region on the downstream side in the direction of coating roller rotation), via which the liquid is sent out from the liquid holding unit to the coating side of the coating roller. This embodiment also reduces the pressing pressure in an abutment region on the upstream side in the direction of coating roller rotation (recovery side for recovering liquid from the surface of the coating roller), thereby enabling the recovery of excess liquid on the roller into the liquid holding unit.

Desirably, the control device controls the abutment pressure-varying device in such a manner that: the first abutment pressure is set to a first pressure value a first time before a leading edge of the medium makes contact with the coating roller; and the first abutment pressure is then set to a second pressure value higher than the first pressure value while the liquid is applied onto the medium.

This embodiment can realize a constant or prescribed coating film thickness by compensating for liquid feed deficiencies at the start of coating. Thus, the bead (thin liquid puddle) is rapidly stabilized at the leading edge region of the medium (the coating start region), thereby enabling uniform coating of the medium by a film of desired thickness. This embodiment in particular contributes to bead stabilization early in the start of coating of an intermittently fed medium and can thus realize a uniform coating on, for example, sheet-form paper.

The "first time (i.e. prescribed time)" referenced here is desirably established based on the time required for the coating surface to travel from the position of liquid feed by the liquid holding unit onto the coating roller to the coating point (point of contact with the medium). Thus, "a first time before a leading edge of the medium makes contact with the coating roller" denotes "immediately before" based on a consideration of the time difference determined in accordance with the roller diameter of the coating roller, the medium transport speed or the roller rotation rate.

Desirably, the control device controls the abutment pressure-varying device in such a manner that: the first abutment pressure is set to a second pressure value until a second time before a trailing edge of the medium passes thorough the coating roller, during a time period when the liquid is applied onto the medium; and the first abutment pressure is set to a third pressure value higher than the second pressure value after the second time before the trailing edge of the medium passes thorough the coating roller.

When the standard first abutment pressure during application of the liquid to the medium is made the "second pressure value", the first abutment pressure is strengthened immediately prior to passage of the back edge (trailing edge) of the medium past the coating roller, which reduces liquid feed to the coating roller. In other words, control of the abutment pressure is carried out within the traverse of the medium during the coating operation. This embodiment can restrain the amount of transfer of coating liquid to the medium support member during the interruption in medium traverse (when the medium has passed by).

Desirably, the control device controls the abutment pressure-varying device in such a manner that: the second abutment pressure is set to a fourth pressure value a third time before a leading edge of the medium makes contact with the coating roller; and the second abutment pressure is then set to a fifth pressure value lower than the fourth pressure value while the liquid is applied onto the medium.

This embodiment can realize a constant or prescribed application film thickness by compensating for liquid feed deficiencies at the beginning of coating.

Desirably, the control device controls the abutment pressure-varying device in such a manner that: the second abutment pressure is set to a fifth pressure value until a fourth time before a trailing edge of the medium passes thorough the coating roller, during a time period when the liquid is applied onto the medium; and the second abutment pressure is set to a sixth pressure value lower than the fifth pressure value after the forth time before the trailing edge of the medium passes thorough the coating roller.

When the standard second abutment pressure during coating is made the "fifth pressure value", the contact nip width between the medium and the coating roller is reduced by a weakening of the second abutment pressure immediately prior to the back edge of the medium pasts the coating roller, and the amount of transfer of coating liquid to the medium support member during the interruption in medium traverse (when the medium has passed by) can be restrained.

Desirably, the liquid coating apparatus comprises a medium position detection device that detects a position of an edge of the medium that is to make contact with the coating surface of the coating roller.

In a preferred embodiment, the medium position detection device is disposed before the contact between the medium and coating roller (upstream side from the coating roller considered along the direction of medium transport) and the position of the front (leading) edge of the medium is acquired and the abutment pressure-varying device is controlled based on this data.

In order to attain an object described above, another aspect of the present invention is directed to an image forming apparatus comprising: one of the above-described liquid coating apparatuses, applying a first liquid onto a medium; and a liquid ejection head which deposits a second liquid on the medium onto which the first liquid has been applied by the liquid coating apparatus.

The "image forming apparatus" is not restricted to a so-called graphic printing application for printing photographic prints or posters, but rather also encompasses industrial apparatuses which are able to form patterns that may be perceived as images, such as resist printing apparatuses, wire printing apparatuses for electronic circuit substrates, ultra-fine structure forming apparatuses, or the like.

Desirably, the second liquid is an ink containing colorant, and the first liquid is an aggregating agent that has an ability to induce the aggregation of the colorant.

This embodiment can improve the accuracy of the amount of aggregating agent application and thus can prevent the image irregularities and inconsistencies that are caused by a lack of uniformity in the aggregating agent and thereby enables the formation of a high-quality image. An inkjet recording apparatus is one embodiment of the image-forming apparatus. Such an inkjet recording apparatus comprises: a liquid ejection head (this corresponds to a "recording head") having a nozzle from which an ink liquid droplet is ejected in order to form a dot, and a pressure generation device (such as a piezoelectric element or a thermal element) generating an ejection pressure; and an ejection control device which controls the ejection of a liquid droplet from the recording head according to ink ejection data that is generated from the image data. The inkjet recording apparatus can form an image on a recording medium by liquid droplets ejected from nozzles.

In order to attain an object described above, another aspect of the present invention is directed to a liquid coating method that uses a liquid coating apparatus including: a coating roller which has a coating surface applying a liquid onto a medium; a liquid holding unit which abuts against the coating surface of the coating roller so as to form a liquid holding space from which the liquid is fed to the coating surface; and a medium support member which faces the coating surface of the coating roller across the medium in such a manner that the medium support member and the coating roller nip and support the medium, the method comprising the step of rotating the coating roller in such a manner that the liquid is fed to the coating surface from the liquid holding unit and the liquid is transferred to the medium from the coating surface, wherein at least one of a first abutment pressure exerted between the coating surface of the coating roller and the liquid holding unit and a second abutment pressure exerted between the coating surface of the coating roller and the medium is adjusted according to a relative position of the medium with respect to the coating roller.

The present invention enables a liquid to be uniformly applied in a required thickness on a variety of sheet-form media. The present invention can also prevent the transfer of coating liquid to the medium support member during the interruption in medium traverse and can thereby prevent contamination of the apparatus. In addition, the present invention provides an image-forming apparatus that can record a high-quality image using the herein described liquid coating apparatuses.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
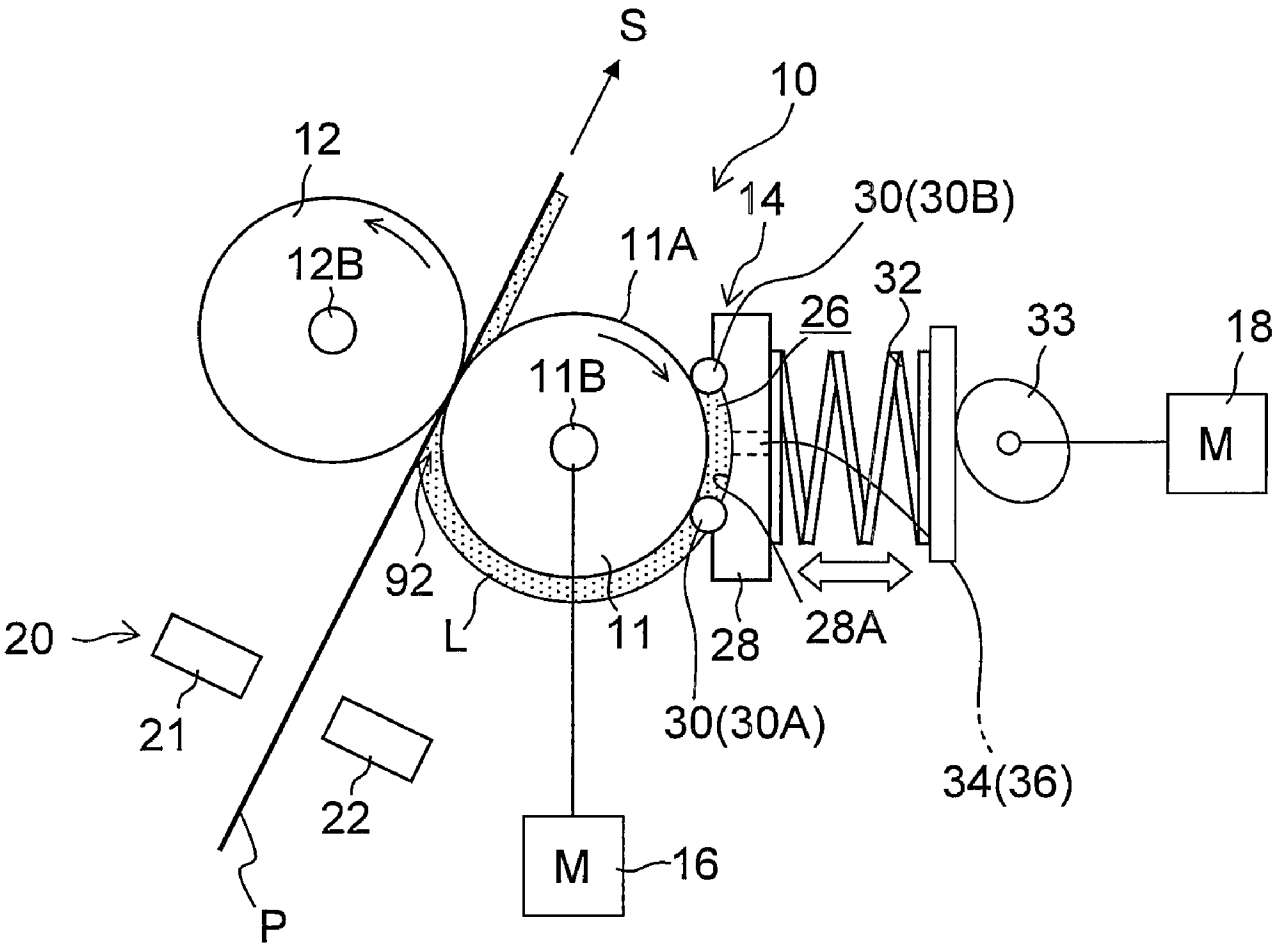
FIG. 1 is a cross-sectional diagram that illustrates the structure of the principal components of a liquid coating apparatus according to an embodiment of the present invention.

FIG. 1 is a cross-sectional diagram illustrating the principal composition of a liquid coating apparatus relating to a first present embodiment. As illustrated in FIG. 1, the liquid coating apparatus 10 comprises: a coating roller 11 which applies an application liquid while rotating in contact with a medium P which forms an application object, a backup roller 12 which is disposed opposing the coating roller 11 via the conveyance path of the medium P (equivalent to a "sheet-form medium"), and a treatment liquid holding cap 14 (equivalent to a "liquid holding unit") which supplies a treatment liquid L to the outer circumferential surface 11A (equivalent to an "application surface") of the coating roller 11.

The coating roller 11 and the backup roller 12 which sandwich the medium P therebetween have rotating axles 11B and 12B following a linear axis direction which is perpendicular to the conveyance direction S of the medium P (namely, the axis direction in perpendicular to the plane of the drawing in FIG. 1 and is referred to below as the "breadthways direction of the medium P"). The coating roller 11 has a width dimension more than that of the medium P in the breadthways direction of the medium P.

The backup 12 has a width equal to or greater than the width of the coating roller 11, and is impelled toward the outer circumferential surface 11A of the coating roller 11 by an impelling device (not illustrated).

A motor 16 is provided as the rotational drive device for the coating roller 11. The coating roller 11 is rotated, in the clockwise direction in FIG. 1, by the transmission of the drive force of this motor 16 to the rotational axle 11B by a power transmission mechanism (not illustrated, for example, a geared transmission mechanism or a belt transmission mechanism). A stepping motor, for example, can be used for the motor 16, while the rotation, stopping, rotation rate, and so forth, of the coating roller 11 are controlled by a drive controller for the motor 16. The backup roller 12 is driven by the rotation of the coating roller 11 and rotates in the counterclockwise direction in FIG. 1.

The medium P is fed to the nip region of the coating roller 11 and the backup roller 12 by a medium feed mechanism (not illustrated) and is transported at a constant velocity in the direction of the arrow S in FIG. 1 by a transport device (not illustrated), e.g., transport rollers and so forth. The coating surface (peripheral surface 11A) of the coating roller 11 rotates at the same velocity as the transport velocity of the medium P.

A sensor 20 that detects the position of the medium P (front edge of sheet-form paper) is disposed in front (upstream with reference to the transport direction of the medium P) of the nip region between the coating roller 11 and the backup roller 12. Known devices based on various methods can be used as the device for detecting the front edge of the medium P; however, an optical detection apparatus comprising, for example, a light-emitting element 21 and a light-receiving element (a photoelectric transducer) 22 is desirably used and is disposed on the transport path of the medium P. The interruption of the light incident on the light-receiving element 22 by the passage of the medium P causes a change in the output signal from the light-receiving element 22. Thus, the front edge of the medium P is detected when the light incident on the light-receiving element 22 is interrupted, while the back edge is detected when the incidence of light is resumed from such an interrupted condition. The timing according to which the front edge of the medium P reaches the coating roller 11 can be acquired from the transport velocity of the medium P and the distance from the position of the sensor 20 to the position of the coating roller 11. A reflective sensor can also be used in place of the transmission photointerrupter.

The treatment liquid holding cap 14 comprises a space forming base material 28 which has the shape of a recess section 28A that forms a space for a treatment liquid storage section 26, and an abutment member 30 which abuts against the outer circumferential surface 11A of the coating roller 11. This abutment member 30 is in intimate contact with the peripheral surface 11A of the coating roller 11 when the coating roller 11 is stopped and thereby functions as a sealing member that prevents leakage from the treatment liquid reservoir 26. The material of the abutment member 30 desirably exhibits some degree of elasticity, and, viewed from the perspective of lowering the sliding resistance, a hardness in the range of 30 to 80° is preferred. Silicone rubber or fluororubber having a hardness in the indicated range is even more preferred. The abutment member 30 desirably has a structure that can be exchanged when wear has occurred.

An urging member 32, such as a spring member, is provided on the rear side of the space forming base material 28 on which the abutment member 30 is provided, and the treatment liquid holding cap 14 is impelled toward the outer circumferential surface 11A of the coating roller 11 by the impelling force of the impelling member 32. In addition, a cam 33 is provided as a means that can variably adjust the actuating force exerted by this urging member 32. This cam 33 is driven and controlled by a motor 18, and the pressing pressure of the treatment liquid holding cap 14 can be controlled by controlling the amount of push on the back end of the urging member 32. This use of a structure that presses the liquid treatment holding cap 14 via the urging member 32 makes it possible to achieve a constant or prescribed pressing pressure even when the coating roller 11 has undergone some wear.

In addition to a cam mechanism, a device such as, for example, a rack pinion, pneumatic cylinder, ball screw, or linear motor, can be used as the mechanism that controls the amount of push on the urging member 32. Due to the pressing mechanism including the above-mentioned urging member 32 and the cam 33, the abutment member 30 of the treatment liquid holding cap 14 is pressed in close contact against the peripheral surface 11A of the coating roller 11.

In an abutted state of this kind, a sealed treatment liquid storage section 26 (also called a "liquid holding space") is formed by the outer circumferential surface 11A of the coating roller 11, the abutment member 30, and the recess section 28A of the space forming base material 28. Treatment liquid L is filled into this sealed liquid holding space (treatment liquid storage section 26).

When the coating roller 11 is rotated in the clockwise direction in FIG. 1 while the treatment liquid is present in the treatment liquid reservoir 26, the coating roller 11 undergoes a sliding motion with respect to the abutment member 30 and the treatment liquid L is fed onto the peripheral surface 11A of the coating roller 11 from the treatment liquid reservoir 26 via the sliding surface with the lower abutment member 30 in FIG. 1 (referred to below as the "lower edge member 30A"). Thus, as the coating roller 11 undergoes rotation, the treatment liquid L is entrained on the peripheral surface 11A of the coating roller 11 and the coating roller 11 transits out from the treatment liquid reservoir 26. The lower edge member 30A of the abutment member 30 therefore functions as a sliding member that forms a treatment liquid outlet member (supply member) for the peripheral surface 11A of the coating roller 11. The treatment liquid L applied to the coating roller 11 is then brought into contact with the medium P as the coating roller 11 rotates and is transferred to the medium P.

The abutment member 30 that is positioned on the upper side in FIG. 1 (referred to below as the "upper edge member 30B") functions as a sliding member in an inlet (return opening) where the coating roller 11 returns to the treatment liquid reservoir 26.

Figure 2:
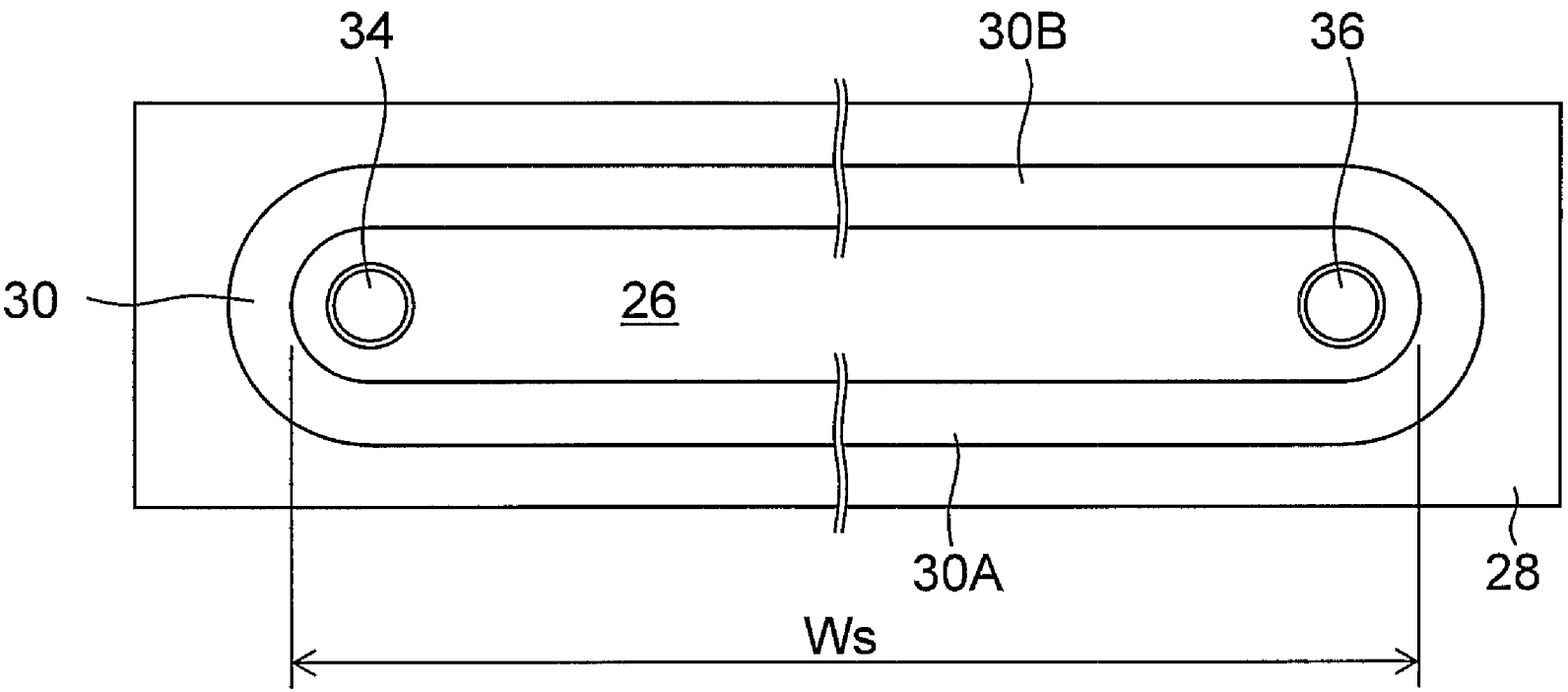
FIG. 2 is a plan diagram of a treatment liquid holding cap.

FIG. 2 is a plan view, as seen from the abutment member 30, of the treatment liquid holding cap 14. In this example, the abutment member 30 is executed in a seamless or joint-free ring shape and is abutted in a sealed manner to the peripheral surface 11A of the coating roller 11 by the urging force of the urging member 32 described with reference to FIG. 1. The treatment liquid reservoir 26 is enclosed by this abutment member 30 and has an open width $W_S$ (refer to FIG. 2) that is equal to the liquid coating width of the coating roller 11 (refer to FIG. 1).

Figure 3:
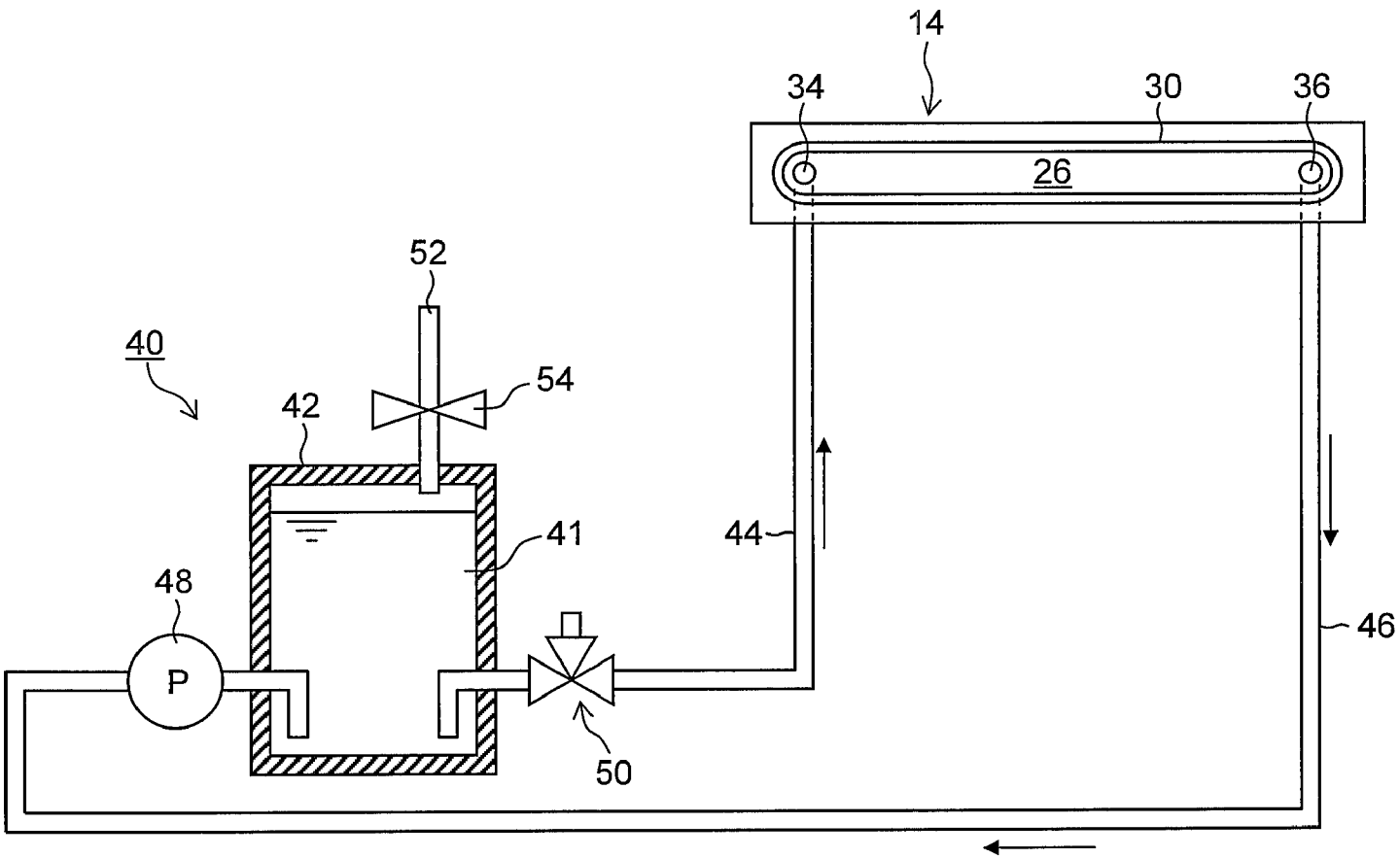
FIG. 3 is a schematic structural drawing of a treatment liquid supply apparatus that is connected to the treatment liquid holding cap.

A liquid supply port 34 and a liquid discharge port 36 are formed in the rear surface side of the space forming base material 28 by through holes which connect with the space of the treatment liquid storage section 26. As illustrated in FIG. 3, a supply flow channel 44 and a recovery flow channel 46 for the treatment liquid are connected respectively to the liquid supply port 34 and the liquid discharge port 36, and the treatment liquid can be supplied to the treatment liquid storage section 26 and treatment liquid can be expelled forcibly from the treatment liquid storage section 26, by driving a pump 48.

FIG. 3 is a general schematic drawing of a treatment liquid supply apparatus 40 which is connected to a treatment liquid holding cap unit 14. The treatment liquid supply apparatus 40 comprises: a storage tank 42 which stores treatment liquid 41; a supply flow channel 44 which leads treatment liquid from the storage tank 42 to the liquid supply port 34 of the treatment liquid holding cap 14; a recovery flow channel 46 which returns treatment liquid from the liquid discharge port 36 of the treatment liquid holding cap 14 to the storage tank 42; a pump 48; and a switching valve (in this case, a three-way valve) 50 which is provided at an intermediate point of the supply flow channel 44.

One end of the supply flow channel 44 is connected to the liquid supply port 34 of the treatment liquid holding cap 14, and the other end is connected to the liquid layer in the storage tank 42. This supply flow channel 44 can be switched so as to open or close the flow channel, and connect to or shut off from the air, by means of the switching valve 50.

One end of the recovery flow channel 46 is connected to the liquid discharge port 36 of the treatment liquid holing cap 14, and the other end is connected to the liquid layer in the storage tank 42. The pump 48 is provided at an intermediate point of the recovery flow channel 46 (desirably, in the vicinity of the storage tank 42), and generates a flow whereby liquid or air is forcibly caused to flow in the direction of the arrows in FIG. 3.

An air connection port 52 is provided in the storage tank 42, and an air connection valve 54 which switches between connecting to and shutting off the air is provided in the air connection port 52.

Description of Control System

Figure 4:
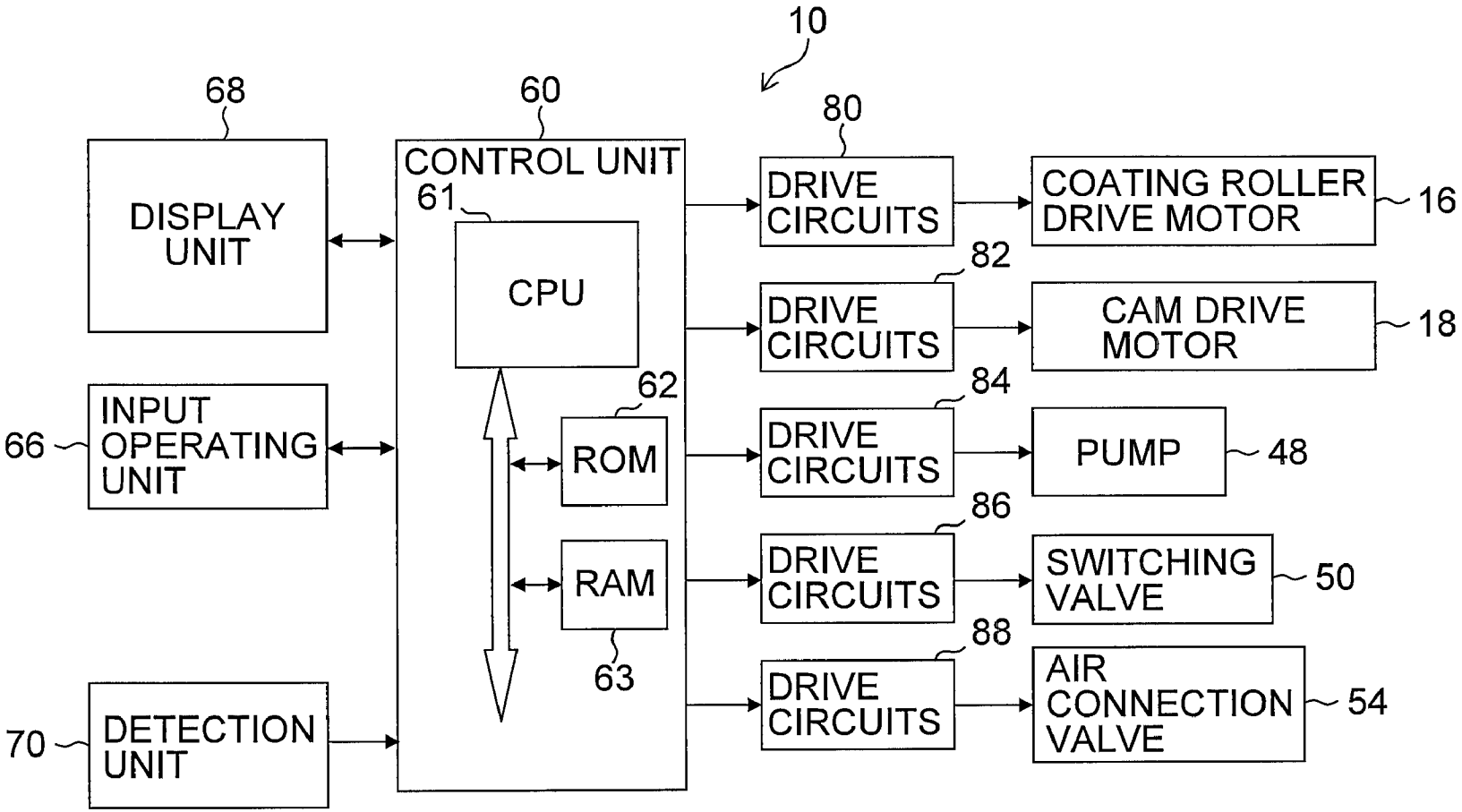
FIG. 4 is a block diagram that illustrates the structure of the control system for a liquid coating apparatus according to an embodiment of the invention.

FIG. 4 is a block diagram illustrating the composition of the control system of a liquid coating apparatus 10 according to the present embodiment.

In FIG. 4, a control unit 60 (which is equivalent to a "control device") is a control device which performs overall control of the whole of the liquid coating apparatus 10. The control unit 60 comprises: a CPU (Central Processing Unit) 61 which executes processing of various types in accordance with prescribed programs; a ROM (Read Only Memory) 62 which stores programs, data of various types, and the like; and a RAM (Random Access Memory) 63 which temporarily stores data, and the like, that is used in the various types of processing.

The input operating unit 66 is constituted by a keyboard and/or mouse (and/or various switches, or the like) which are used to input prescribed instructions or data. The display unit 68 constitutes a user interface together with the input operating unit 66 and provides various displays in conjunction with the control unit 60. For example, the display unit 68 is constituted by a liquid crystal display apparatus.

The liquid coating apparatus 10 is provided with a detection unit 70 comprising the sensor (the medium position detection sensor described for reference symbol 20 in FIG. 1) that detects the position of the medium P (refer to FIG. 1) as well as sensors that detect the operating status of the various members. Signals are sent from the detection unit 70 to the control unit 60 and are used for control of the operation of the roller drive and other members.

The liquid coating apparatus 10 further comprises the motor 16 (indicated as the "coating roller drive motor" in FIG. 4) that drives the coating roller 11 (refer to FIG. 1), the motor 18 (indicated as the "cam drive motor" in FIG. 4) that drives the cam 33 (refer to FIG. 1), the pump 48 (refer to FIG. 4), the switching valve 50, the air connection valve 54, and drive circuits 80, 82, 84, 86, and 88 corresponding to the respective preceding elements. The control unit 60 transmits control signals to the drive circuits 80 to 88 in accordance with the programming in order to control the operation of each of these elements.

A method of controlling the pressing pressure between the coating roller 11 and the treatment liquid holding cap 14 (in some cases referred to hereafter simply as the "cap") before and after interruption of the traverse by the paper sheet (medium P) is described in the following for the liquid coating apparatus 10 according to the present embodiment structured as described above.

CONTROL EXAMPLE 1

Control of the Cap Pressing Pressure

The treatment liquid film thickness on the coating roller 11 can be controlled by the pressing pressure between the coating roller 11 and the treatment liquid holding cap 14. Thus, the treatment liquid film thickness on the coating roller 11 can be controlled by controlling the nip width and the gap between the coating roller 11 and the cap 14.

In this embodiment, the pressing pressure of the cap 14 is strengthened immediately prior to the exit of the back edge of the paper sheet from the coating roller 11 in order to reduce the treatment liquid film thickness on the coating roller 11. In addition, the pressing pressure of the cap 14 is weakened immediately prior to the arrival of the front edge of the next paper sheet at the coating roller 11 in order to increase the treatment liquid film thickness on the coating roller 11. During this sequence, the time profile for control of the pressing pressure of the cap 14 is controlled to secure uniformity for the quantity of application (refer to FIG. 5).

Figure 5:
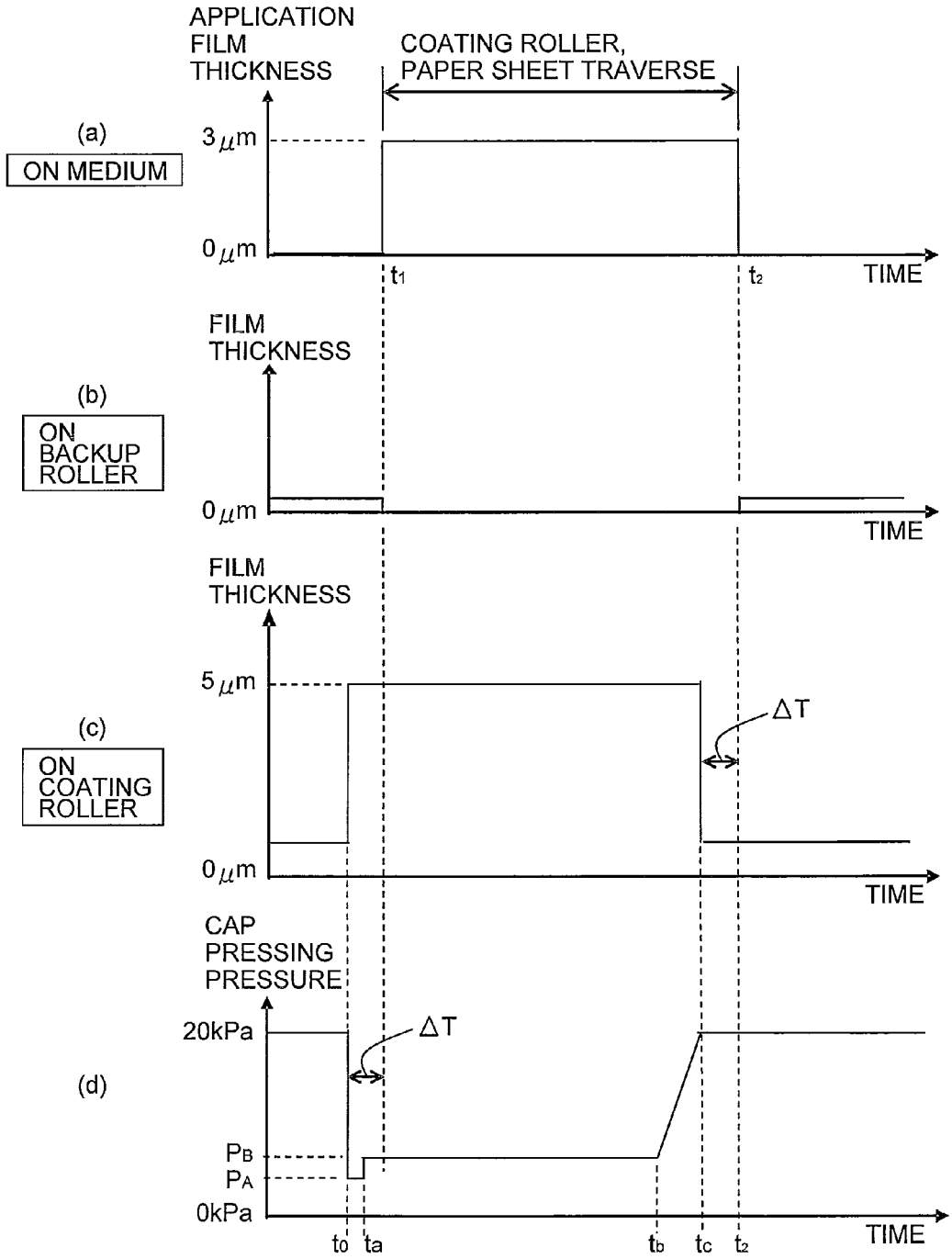
FIG. 5 is a diagram that illustrates charts ((a) to (d)) based on an example of the control of the cap pressing pressure in accordance with an embodiment of the invention.

An example of this is illustrated in FIG. 5. Part (a) in FIG. 5 illustrates the application film thickness on the medium P. Part (b) in FIG. 5 illustrates the treatment liquid film thickness that has been transferred onto the backup roller. Part (c) in FIG. 5 refers to the treatment liquid film thickness on the coating roller 11, wherein this illustrates the treatment liquid film thickness on the coating roller 11 at the abutment position with the abutment member 30 (30A) on the feed side (outlet side) of the treatment liquid holding cap 14. Part (d) in FIG. 5 is the cap pressing pressure (pressing pressure of the cap) that realizes the film thicknesses in parts (a) to (c) in FIG. 5. The horizontal axis indicates time in all instances, and the corresponding relationship between the film thickness and the time profile of the cap pressing pressure control that is illustrated in part (d) in FIG. 5 is indicated. A design example is illustrated here that aims to apply the treatment liquid with a film thickness of 3 μm onto the medium P.

The time $t_1$ to time $t_2$ interval illustrated in part (a) in FIG. 5 represents the time during which the coating roller 11 and medium P are in contact (the paper sheet traverse time). During this interval the treatment liquid is not applied to the backup roller 12 (refer to part (b) in FIG. 5).

As illustrated in part (c) in FIG. 5, a time ΔT is required for rotation of the roller surface from the cap abutment position (cap outlet position) on the coating roller 11 to the coating point (point of contact with the medium P), and for this reason a time difference of just this time ΔT is generated between the control timing of the pressing pressure of the cap 14 and the timing for coating on the medium P. Thus, in order to realize the application film thickness illustrated in part (a) in FIG. 5, in consideration of the time difference ΔT, control of the cap pressing pressure is started with a timing $t_0$ that is ΔT before the time $t_1$. ΔT is approximately 0.5 to 2.0 seconds when the coating roller 11 has a diameter of 20 mm.

As illustrated in part (d) in FIG. 5, the cap pressing pressure $P_0$ is made, for example, 20 kPa, when coating on the medium P is in abeyance (non-coating interval). The pressing pressure of the cap 14 is made $P_A$ (corresponds to the "first pressure value") at a timing to that is ΔT before the time $t_1$ at which the front edge of the medium P comes into contact with the coating roller 11 due to the feed of the medium P, and thereafter the pressing pressure is made $P_B$ (corresponds to the "second pressure value") at time $t_a$ (wherein $t_0<t_a<t_1$ and $0<P_A<P_B<P_0$).

This control according to which the pressing pressure is set to the pressing pressure $P_A$ in the initial stage of the control process ($t_0$ to $t_a$) which is even lower than the pressing pressure $P_B$ during the stable coating operation, has the following functional effects. Specifically, immediately after the start of the outflow of the treatment liquid from the cap 14, the amount of treatment liquid fed to the surface of the coating roller 11 is less than the specified amount. In order to compensate for this deficiency, in the initial stage immediately after the start of control ($t_0$ to $t_a$), the pressing pressure is lowered still further in order to increase the amount of treatment liquid feed. Moreover, the pressing pressure is returned to the standard value ($P_B$) at a time ($t_a$) at which this initial deficiency in the feed has been extinguished. By proceeding in this manner, the liquid bead (reference symbol 92 in FIG. 1) is rapidly stabilized at an early stage of the coating and a uniform coating can be realized.

As illustrated in part (d) in FIG. 5 this is followed by the maintenance of a constant pressing pressure $P_B$, and the pressing pressure is re-strengthened at the rear edge of the medium P (time $t_b$ to $t_c$) to return to $P_0$ (corresponds to the "third pressure value") and thereby narrow down the feed of the treatment liquid.

This proceeding in the described manner makes possible a uniform coating at a constant film thickness in the region where the coating is required and can prevent contamination of the backup roller 12 in the region where the coating is not required.

SECOND EMBODIMENT CONTROL EXAMPLE 2

Control of Pressing Pressure of Coating Roller

The previously described first embodiment is an example in which control is carried out on the pressing pressure of the treatment liquid holding cap 14. In the second embodiment described in the following, the coating roller 11 is displaced in the direction toward the cap 14 in order to control the pressing pressure between the coating roller surface and the treatment liquid holding cap 14 and control the nip pressure between the coating roller 11and the backup roller 12.

Figure 6:
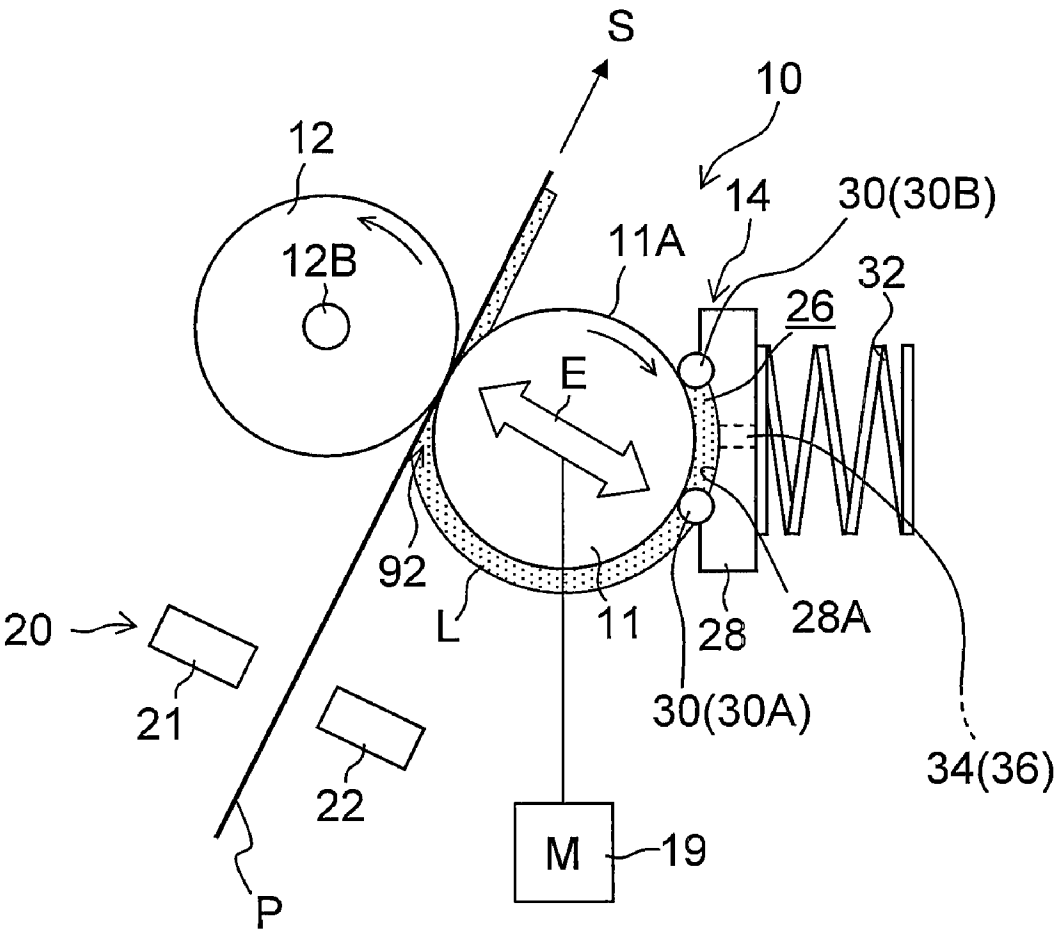
FIG. 6 is a cross-sectional diagram that illustrates the structure of the principal components of a liquid coating apparatus according to another embodiment of the present invention.

A structural drawing of the second embodiment is illustrated in FIG. 6. Elements in FIG. 6 that are the same as or similar to the elements in FIG. 1 are assigned the same reference symbols as in FIG. 1 and will not be described again. For the sake of convenience in illustration, the motor 16 that drives the rotation of the coating roller 11 has been omitted from FIG. 6.

The liquid coating apparatus 100 illustrated in FIG. 6 is provided with a displacement mechanism (not illustrated) that displaces the coating roller 11 in the direction of the unfilled white arrow E in FIG. 6. The coating roller 11, which is supported by this displacement mechanism, can undergo parallel displacement in the direction of the arrow E due to the drive force of the motor 19. The direction indicated by the arrow E in the figure is the direction of a straight line that connects the coating point on the coating roller 11 (the point of contact with the medium P) with the abutment member 30 (lower edge member 30A) on the treatment liquid outlet (supply) side of the cap 14, and in the example under consideration it is a direction orthogonal to the surface of the medium P.

When the coating roller 11 is displaced in the direction in which it approaches the cap 14 along this displacement direction, then the pressing pressure between it and the abutment member 30 (lower edge member 30A) on the treatment liquid outlet (supply) side of the cap 14 is increased while the pressing pressure between it and the abutment member 30 (upper edge member 30B) on the treatment liquid return opening (recovery) side of the cap 14 is reduced. This enables the effective recovery of surplus liquid on the coating roller surface while limiting the feed of the treatment liquid onto the coating roller surface.

The pressing pressure between the coating roller 11 and the cap 14 is varied by displacing the coating roller 11 in the direction of the arrow E in the structure illustrated in FIG. 6; this displacement also controls the status of contact between the coating roller 11 and the medium P (contact nip width between the coating roller 11 and the medium P, or the nip pressure between the coating roller 11 and the backup roller 12).

Thus, when the coating roller is displaced in such a manner that it draws back from the medium P (to the side of separation of the coating roller from the medium P) immediately prior to the exit of the back edge of the medium P from the coating roller, the pressing pressure by the cap 14 is raised and the treatment liquid film thickness on the coating roller 11 is thereby reduced, and the contact nip width between the medium P and the coating roller 11 (the length of the contact region of the coating roller 11 with respect to the medium P, in terms of the conveyance direction S of the contact region) is reduced, resulting in a reduction in the amount of transfer. In this operation, the coating roller 11 may be completely separated from the medium P, in which case a mechanism that assists with the transport of the medium P should be provided.

After this, the coating roller 11 is displaced in the direction of the medium P (toward the backup roller 12) immediately prior to the arrival of the front edge of the next medium P at the coating roller 11, which causes the pressing pressure of the cap 14 to be weakened and the treatment liquid film thickness on the coating roller 11 is thereby increased, and which also causes the contact nip width between the medium P and the coating roller 11 to be increased and the amount transferred is thereby increased. The time profile of coating roller displacement is controlled here to maintain a uniform quantity of application on the medium P.

Figure 7:
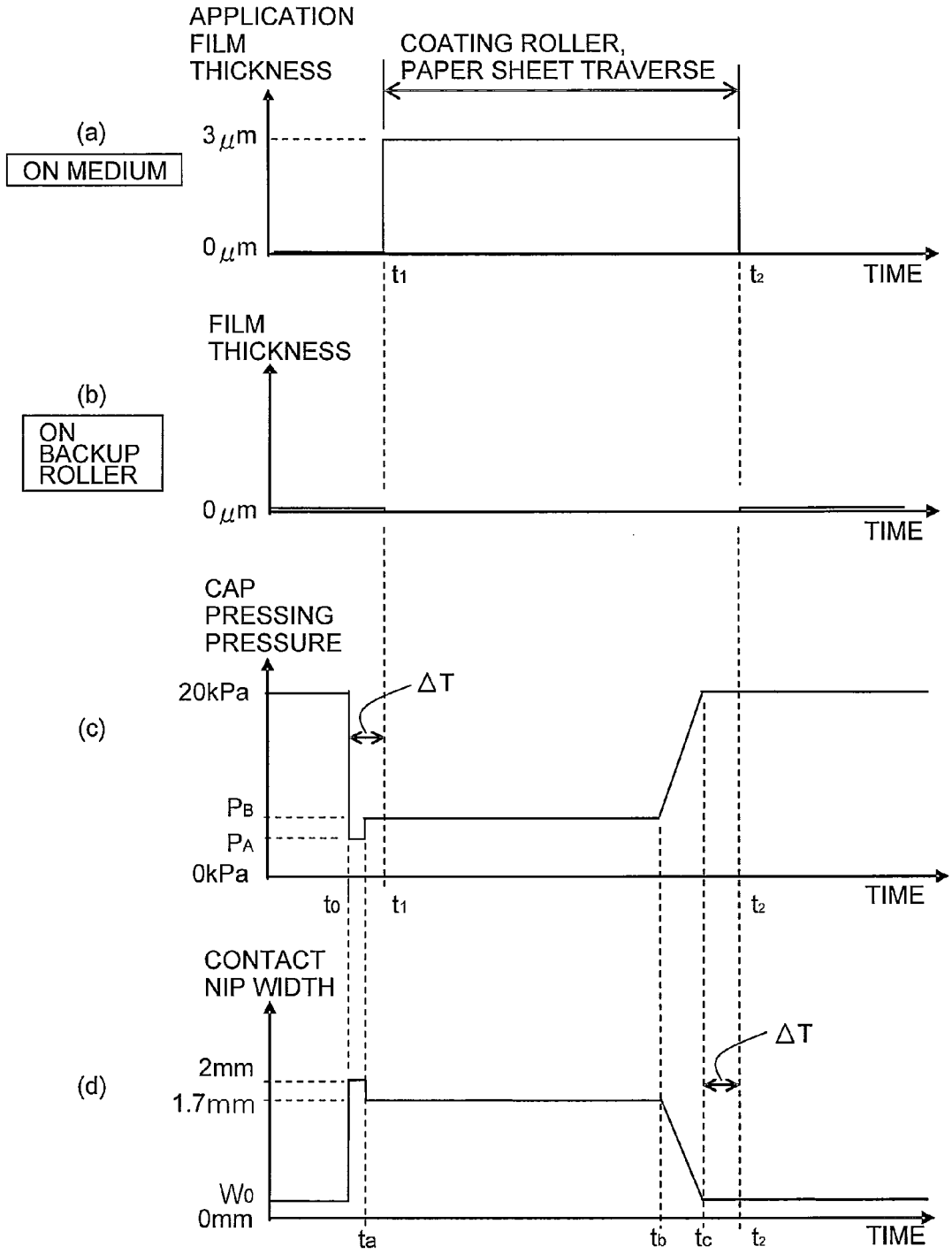
FIG. 7 is a diagram that illustrates charts ((a) to (d)) based on an example of the control of the coating roller pressing pressure for the embodiment illustrated in FIG. 6.

An example of this control is illustrated in FIG. 7. Part (a) in FIG. 7 illustrates the application film thickness on the medium P, while part (b) in FIG. 7 illustrates the treatment liquid film thickness that has been transferred onto the backup roller. Part (c) in FIG. 7 refers to the cap pressing pressure, while part (d) in FIG. 7 refers to the contact nip width. The horizontal axis indicates time in all instances, and the corresponding relationship between the film thickness and the time profile of the cap pressing pressure control that is illustrated in parts (c) and (d) in FIG. 7 is indicated. A design example is illustrated here that aims to apply the treatment liquid with a film thickness of 3 μm onto the medium P.

As is clear from part (b) in FIG. 7, in this example even less treatment liquid is transferred to the backup roller 12 in the region outside the paper sheet transit interval (compared with part (b) in FIG. 5).

With reference to the contact nip width illustrated in part (d) in FIG. 7, the contact nip width is $W_0$ when coating on the medium P is in abeyance (non-coating interval), and the contact nip width is made $W_A$ (for example, 2 mm) at a timing to that is ΔT before the time $t_1$ at which the front edge of the medium P comes into contact with the coating roller 11. Subsequent to this, the contact nip width is brought to $W_B$ (for example, 1.7 mm) at the time $t_a$. The contact nip width $W_B$ is maintained during the stable coating operation and is returned to $W_0$ at the back edge of the medium P (time $t_b$ to $t_c$), thereby reducing the amount of transfer to the medium P while reducing the feed of the treatment liquid.

This makes it possible to achieve uniform coating at a constant film thickness while also making it possible to prevent contamination of the backup roller 12 in the region where coating is not required.

The contact nip width $W_A$ in this example is the contact nip width realized by the abutment pressure corresponding to the "fourth pressure value". In addition, $W_B$ is the contact nip width realized by the abutment pressure corresponding to the "fifth pressure value", while $W_0$ is the contact nip width realized by the abutment pressure corresponding to the "sixth pressure value".

In the control system structure in the liquid coating apparatus 100 according to the hereinabove-described second embodiment, the motor 19 (refer to FIG. 6) is provided for driving the displacement mechanism for the coating roller 11, instead of the cam drive motor (reference symbol 18) of FIG. 4. The block diagram is otherwise the same as FIG. 4 and is omitted for this reason.

Explanation of Application Step

Figure 8:
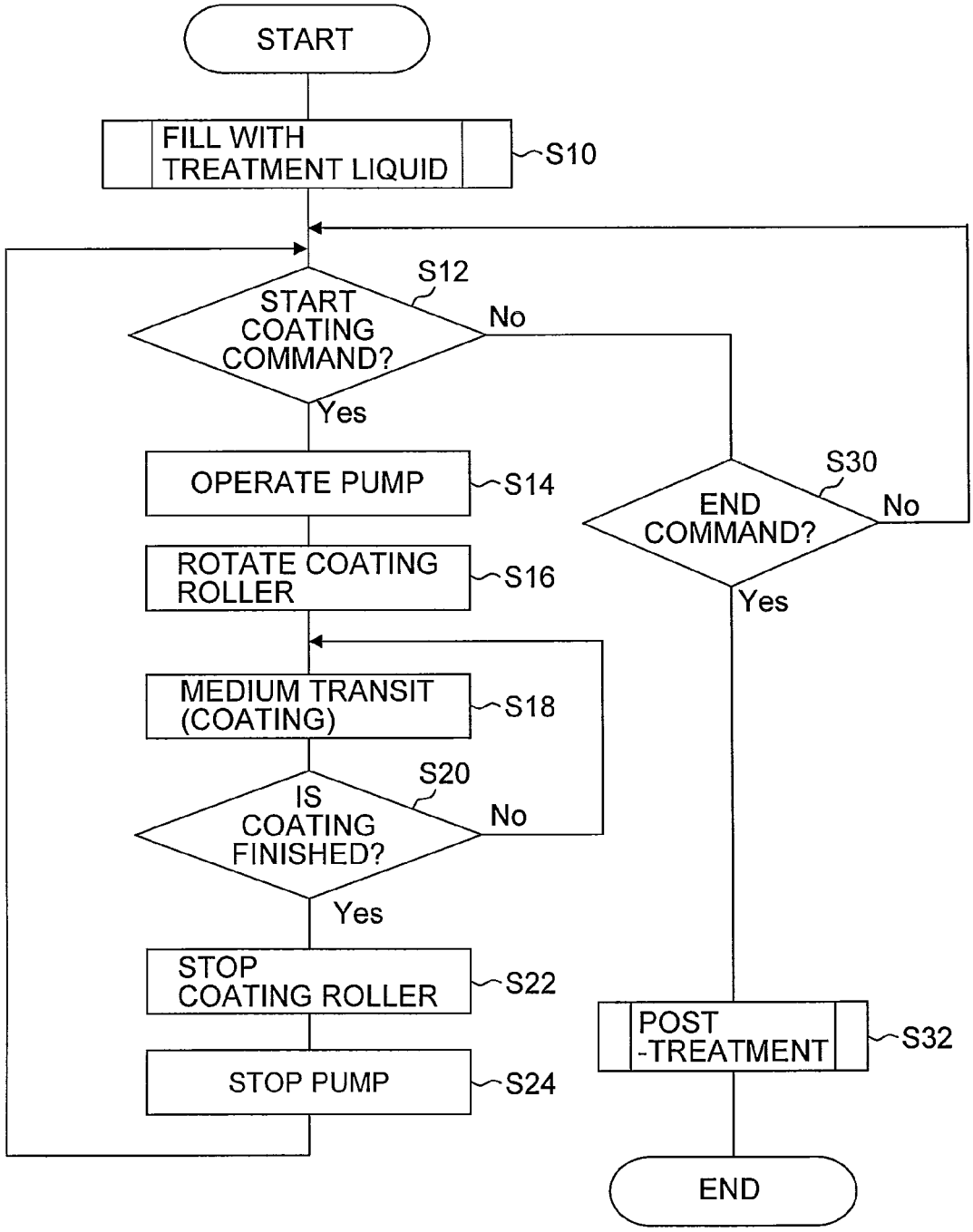
FIG. 8 is a flowchart that illustrates the operating sequence of the liquid coating apparatus.

FIG. 8 is a flowchart illustrating the operational sequence of the liquid coating apparatus 10, 100. These operations are executed in accordance with a program(s), under the control of the control unit 60 illustrated in FIG. 4.

Firstly, in an initial state when this sequence is started, treatment liquid has not been introduced into the treatment liquid storage section 26, which is in an empty state, and at step S10, a step of filling treatment liquid into the treatment liquid storage section 26 of the treatment liquid holding cap 14 is carried out. In this filling step, the switching valve 50 of the supply flow channel 44 is set to the supply flow channel side (a state which opens the supply flow channel 44), and furthermore the air connection valve 54 of the storage tank 42 is opened and the pump 48 is driven for a certain period of time in a state where the storage tank 42 is connected to the air.

Accordingly, the air inside the space is sent to the storage tank 42 and is expelled into the outside air from the storage tank 42, while at the same time treatment liquid is filled into the respective units of the supply flow channel 44, the treatment liquid storage unit 26 and the recovery flow channel 46. In this way, a state is achieved in which treatment liquid can be supplied to the coating roller 11 which lies in contact with the treatment liquid storage unit 26. The driving time period of the pump 48 is set by anticipating the time taken to complete the initial filling operation. After driving for a prescribed time period, the pump 48 is halted.

Thereupon, the presence or absence of an application start command is judged (step S12). An application start command signal is issued in coordination with the conveyance of the medium P. The application start command signal is issued at a prescribed time differential in such a manner that the application of treatment liquid starts at the time when the medium P arrives at the nip section between the coating roller 11 and the backup roller 12.

When the application start command is input and a YES verdict is obtained at step S12, then the pump 48 is operated (step S14), and furthermore the roller driving is started to rotate the coating roller 11 in the clockwise direction in FIG. 1 (step S16). This rotation of the coating roller 11 supplies a surface of the coating roller 11 with the treatment liquid in the space forming base material 28.

In this way, the treatment liquid adheres to the outer circumferential surface 11A of the coating roller 11 in the form of a layer. The treatment liquid adhering to the circumferential surface of the coating roller 11 rotates with the coating roller 11, and is conveyed to an abutting section with the backup roller 12.

Then, by means of the medium P being conveyed by the medium conveyance mechanism, the medium P is supplied between the coating roller 11 and the backup roller 12. The medium P nipped between the two rollers 11 and 12 is conveyed, and furthermore, when it is conveyed between the rollers, the treatment liquid on the outer circumferential surface of the coating roller 11 is transferred to the medium P (step S18). When this coating operation is performed, the pressing pressure control, which has been explained in reference to FIG. 5 (charts (A) to (D)) and FIG. 7 (charts (A) to (D)), is executed.

When the application operation onto the medium P described above has been carried out, the control unit 60 judges the end timing of the application operation (step S20 in FIG. 8). If liquid is applied to the whole surface of the medium P, then the judgment at step S20 produces a NO verdict and returns to step S18, until the medium P has passed completely.

If it is judged that the application step in the required application range has been completed (YES verdict at step S20), for instance, the timing of the passage of the trailing edge of the medium P is detected or the end of a job of a specified number of sheets is detected, then the coating roller 11 is halted (step S22).

In addition, the coating roller 11 is stopped (step S22) and the pump 48 is stopped (step S24). Step S24 is followed by a return to step S12.

At step S12, if a new application start command is input, then the processing in step S14 to step S24 described above is repeated. On the other hand, if at step S12 the application start command has not been input, then the procedure advances to step S30, and it is judged whether or not there is an application end command (step S30). The end command may use one of various modes, such as a mode where an end command is issued automatically when a specified wait time has elapsed on the basis of time management using a timer, or the like, a mode where an end command is issued when application onto a specified number of sheets of media has been completed, a mode based on an operation from the input operating unit 66, or a mode based on a switching off operation of the apparatus power supply, or the like.

If an end command has not been input, then the procedure returns to step S12. At step S30, if an end command has been input, then the procedure advances to the subsequent processing step in step S32. The subsequent processing step (step S32) involves an operation for recovering into the storage tank 42 the treatment liquid inside the treatment liquid storage section 26 of the treatment liquid holding cap 14, and the supply flow channel 44 and recovery flow channel 46 which are connected to same.

This recovery operation is carried out by opening the switching valve 50 to the air, and closing the air connection valve 54 of the storage tank 42 and driving the pump 48 for a prescribed period of time. A sufficient pump driving time is established in order that all of the treatment liquid remaining inside the respective sections is caused to flow into the storage tank 42.

After the recovery operation, the air connection valve 54 is closed, the switching valve 50 is also closed, and furthermore, the supply flow channel 44 is shut off and the connection to the outside air is shut off. In this way, the storage tank 42 is closed off from the outside air, thereby preventing evaporation or leakage to the exterior.

Example of Application to Image Forming Apparatus

Figure 9:
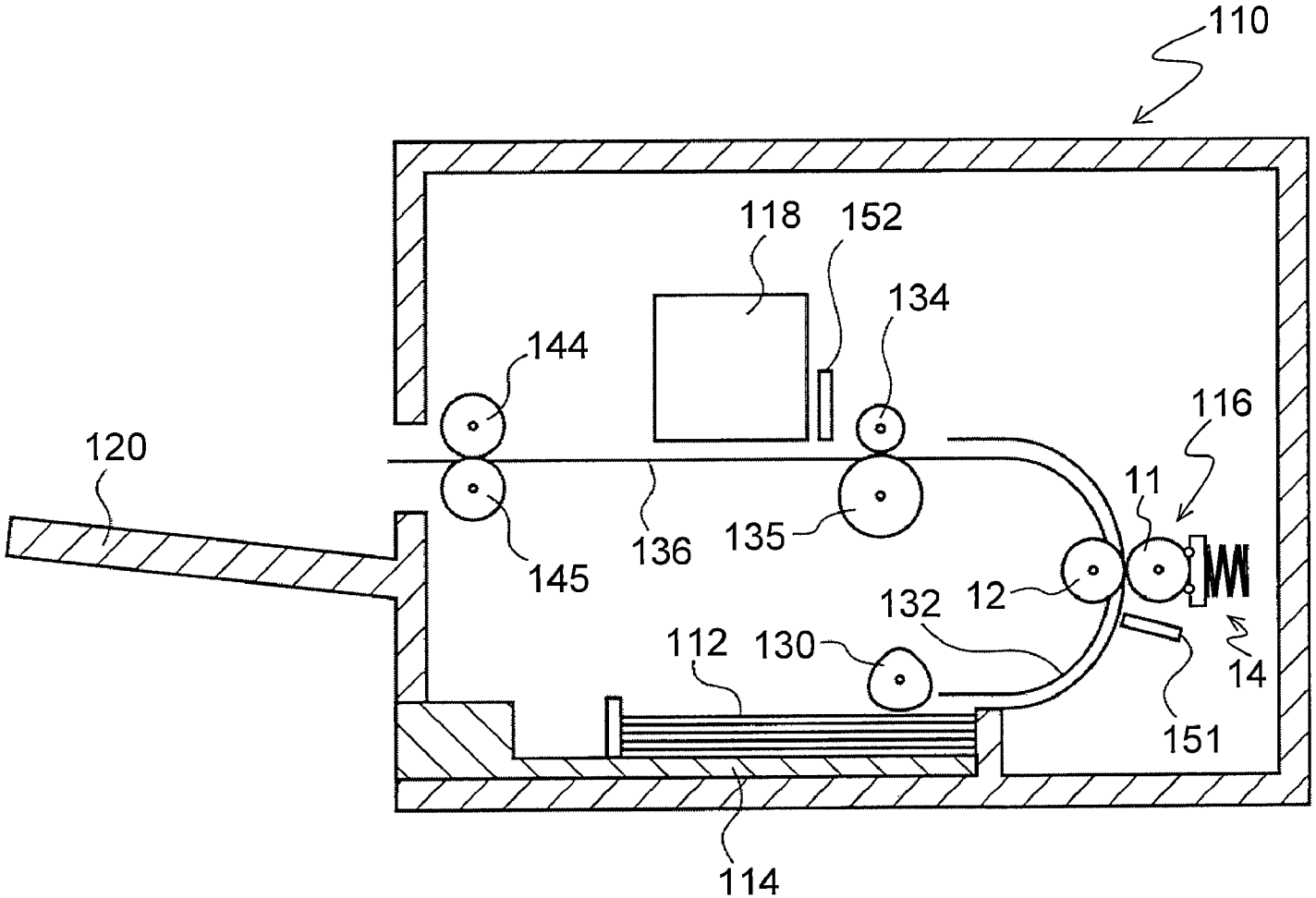
FIG. 9 is a structural diagram of an inkjet recording apparatus according to an embodiment of the present invention.

FIG. 9 is a schematic drawing of an inkjet recording apparatus relating to one example of an image forming apparatus which comprises a liquid coating apparatus according to an embodiment of the present invention.

The inkjet recording apparatus 110 comprises: a paper supply unit 114 which supplies a recording medium 112 (equivalent to the "medium P" illustrated in FIG. 1); a treatment liquid application unit 116 which applies treatment liquid to the recording medium 112 supplied from the paper supply unit 114; an ink droplet ejection unit 118 which ejects droplets of ink onto the recording medium 112 after the application of treatment liquid; and a paper output tray 120 where the recording medium 112 on which an image has been formed by the ink droplet ejection unit 118 is output.

The paper supply unit 114 employs a method based on a paper supply cassette in which a plurality of sheets of recording media 112 cut to a prescribed size are loaded. It is also possible to provide a plurality of paper supply cassettes in such a manner that papers of a plurality of different sizes can be supplied. Furthermore, it is also possible to adopt a mode in which rolled paper (continuous paper) is used instead of cut sheet, and the rolled paper is cut to an appropriate size by a cutter.

The recording medium 112 which is loaded in the paper supply unit 114 is supplied to the conveyance path 132 repeatedly, one sheet at a time, by the paper supply roller 130. The treatment liquid application unit 116 which is provided in the conveyance path 132 employs the composition of the liquid coating apparatus 10 or the liquid coating apparatus 100 illustrated in FIG. 1 to FIG. 8. In FIG. 9, elements which are the same as or similar to the liquid coating apparatus 10, 100 described with reference to FIG. 1 to FIG. 8 are labeled with the same reference numerals and description thereof is omitted here. In FIG. 9, for the sake of convenience, only a portion of the treatment liquid holding cap 14 in the liquid coating apparatus 10, 100 is depicted.

The recording medium 112 onto which treatment liquid has been applied by the application roller 11 of the treatment liquid application unit 116 is conveyed over the platen 136 by the conveyance roller pairs 134 and 135.

The ink droplet ejection unit 118 is provided on the downstream side of the treatment liquid holding cap 14 in terms of the direction of conveyance of the medium. The ink droplet ejection unit 118 according to the present example is constituted by recording heads of an inkjet type which correspond respectively to inks of four colors of yellow (Y), magenta (M), cyan (C) and black (K). Although not illustrated in the drawings, inks of the corresponding colors are supplied respectively to the recording heads of the respective colors, from ink tanks which are not illustrated.

The recording heads of the respective colors in the ink droplet ejection unit 118 are each heads of a full line type which respectively have a length corresponding to the maximum width of the image forming region on the recording medium 112 and comprise a plurality of ink ejection nozzles arranged through the full width of the image forming region on the ink ejection surface of the head.

The recording heads of the respective colors are fixed so as to extend in a direction perpendicular to the direction of conveyance of the recording medium 112 (the direction perpendicular to the plane of the drawing in FIG. 9), and respectively eject liquid droplets of the corresponding colored ink onto the recording medium 112 on the platen 136.

In this way, according to a composition in which full line heads having nozzle rows covering the full width of the image forming region of the recording medium 112 are provided for each color of ink, it is possible to record an image on the image forming region of the recording medium 112 by performing just one operation of moving the recording medium 112 and the recording head relatively with respect to each other in the direction of conveyance of the recording medium 112 (the sub-scanning direction), in other words, by performing just one sub-scanning.

It is also possible to adopt a mode which employs, instead of full line heads, heads of a serial (shuttle) type which move reciprocally back and forth in a direction (main scanning direction) perpendicular to the direction of conveyance of the recording medium 112 (sub-scanning direction), but forming an image by a single pass method using heads of a full line type (page-wide heads) enables faster printing than a multi-pass method using serial (shuttle) type heads, and therefore the print productivity can be improved.

Although the configuration with the CMYK four colors is described in the present embodiment, combinations of the ink colors and the number of colors are not limited to those. Light inks, dark inks or special color inks can be added as required. For example, a configuration is possible in which recording heads for ejecting light-colored inks such as light cyan and light magenta are added. Furthermore, there are no particular restrictions of the sequence in which the heads of respective colors are arranged.

Possible examples of the ink used in the inkjet recording apparatus 110 according to the present embodiment include a dye-based ink in which a coloring material is dissolved in a molecular state (an ionic state is also possible) in the solvent of the liquid, and a pigment-based ink in which a coloring material is dispersed in the solvent of the liquid in a state of small particles.

On the other hand, the treatment liquid is a liquid which generates an aggregate of the coloring material when mixed with an ink. Specific examples of the treatment liquid include a treatment liquid which precipitates or insolubilizes the coloring material in the ink by reacting with the ink, and a treatment liquid which generates a semi-solid material (gel) that includes the coloring material in the ink, and the like.

The means of generating a reaction between the ink and the treatment liquid may be a method which causes an anionic coloring material in the ink with a cationic compound in the treatment liquid, a method which aggregates pigment by breaking down the dispersion of the pigment in the ink due to altering the pH of the ink by mixing an ink and a treatment liquid which have different pH values, a method which aggregates pigment by breaking down the dispersion of the pigment in the ink due to a reaction with a polyvalent metal salt in the treatment liquid, or the like.

For instance, examples of a treatment liquid having an action of aggregating the coloring material contained in ink which is ejected as droplets from the ink droplet ejection unit 118 according to the present embodiment are aggregating treatment agents, such as a polyvalent metal salt, polyallylamine, a polyallylamine derivative, an acidic liquid, a cationic surfactant, and the like. By promoting the aggregation of the coloring material on the recording medium 112 by means of a treatment liquid of this kind, it is possible to improve the recording density as well as reducing or preventing bleeding.

The recording medium 112 on which an image has been formed by ejection of ink droplets from the ink droplet ejection unit 118 (the medium which has completed recording) is output to the output tray 120 by a pair of output rollers 144 and 145.

Medium leading edge determination sensors 151 and 152 which determine the leading edge of the recording medium 112 are disposed in the conveyance path 132 of the recording medium 112. The first medium leading edge determination sensor 151 is equivalent to the sensor 20 in FIG. 1, and is disposed in the vicinity of the input to the application roller 11 on the paper supply side. The second medium leading edge determination sensor 152 is disposed in the vicinity of the input to the ink droplet ejection unit 118 on the paper supply side.

The position of the recording medium 112 is detected by these sensors (151, 152), enabling control of, for example, the timing of treatment liquid application, the rotation driving of the coating roller 11 and the backup roller 12, the ink ejection timing, and so forth.

Treatment Liquid Examples

Any liquid in the prescribed viscosity range can be used as the liquid that is applied by the liquid coating apparatus 10, 100 according to embodiments of the present invention, while aggregation treatment solutions as described in the following are desirably used with the inkjet recording apparatus illustrated in FIG. 9.

Thus, examples of the treatment liquid (reaction liquid) that reacts with the ink contain the following as the reactive agent: polyvalent metal salts, polyallylamines, polyallylamine derivatives, acidic liquids, cationic surfactants, or the like.

Preferred examples of the reactive agent when it is a polyvalent metal salt include water-soluble salts comprising an at least divalent polyvalent metal ion and an anion bonded to the polyvalent metal ion. Specific examples of the polyvalent metal ion are divalent metal ions such as $Ca^{2+}$, $Cu^{2+}$, $Ni^{2+}$, $Mg^{2+}$, $Zn^{2+}$, $Ba^{2+}$, and so forth, as well as trivalent metal ions such as $Al^{3+}$, $Fe^{3+}$, $Cr^{3+}$, and so forth. The anion can be exemplified by $Cl^-$, $NO_3^-$, $I^-$, $Br^-$, $ClO_3^-$, $CH_3COO^-$, and so forth.

In particular, a metal salt comprising $Ca^{2+}$ or $Mg^{2+}$ provides excellent effects from two perspectives, i.e., the pH of the reaction liquid and the quality of the resulting printed material.

The concentration of these polyvalent metal salts in the reaction solution may be determined as appropriate in view of, for example, the print quality, but approximately 0.1 to 40 wt % (weight percent) is preferred and approximately 5 to 25 wt % is more preferred.

In a preferred embodiment of the present invention, the polyvalent metal salt present in the reaction solution is water soluble and comprises an at least divalent multivalent metal ion and the nitrate ion or carboxylate ion bonded to the polyvalent metal ion.

This carboxylate ion is desirably derived from a $C_{1-6}$ (i.e. the number of carbon is 1 to 6) saturated aliphatic monocarboxylic acid or a $C_{7-11}$ carbocyclic monocarboxylic acid. Preferred examples of the $C_{1-6}$ saturated aliphatic monocarboxylic acid are formic acid, acetic acid, propionic acid, butyric acid, isobutyric acid, valeric acid, isovaleric acid, pivalic acid, hexanoic acid, and so forth, wherein formic acid and acetic acid are particularly preferred.

The hydrogen on the saturated aliphatic hydrocarbyl moiety of this monocarboxylic acid may be replaced by the hydroxyl group, wherein lactic acid is a preferred example of such a carboxylic acid.

Preferred examples of the $C_{6-10}$ carbocyclic monocarboxylic acid are benzoic acid, naphthoic acid, and so forth, wherein benzoic acid is more preferred.

Polyallylamines and polyallylamine derivatives preferred for use as the reactive agent are water-soluble cationic polymers that bear a positive charge in water. For example, there are the following formulas (I), (II), and (III).

Chemical formulas (I), (II), and (III)

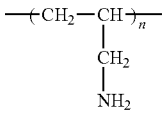

(I)

-continued

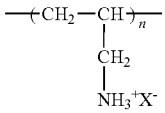

(II)

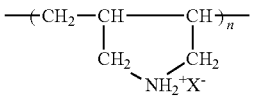

(III)

(In the formulas, $X^-$ represents, for example, the chloride ion, bromide ion, iodide ion, nitrate ion, phosphate ion, sulfate ion, acetate ion, and so forth.) In addition to the preceding, polymers in which allylamine is copolymerized with diallylamine and copolymers between sulfur dioxide and diallylmethylammonium chloride can also be used. The content of the polyallylamine and polyallylamine derivative is desirably 0.5 to 10 wt % of the reaction liquid.

An acid, such as those listed below, is also desirably used as a component of the treatment liquid. This acid is desirably selected from polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidonecarboxylic acid, pyronecarboxylic acid, pyrrolecarboxylic acid, furancarboxylic acid, pyridinecarboxylic acid, coumalic acid, thiophenecarboxylic acid, nicotinic acid, derivatives of these compounds, their salts, and so forth.

In a preferred embodiment of the present invention, the reaction liquid may also contain an anti-drying agent (wetting agent) comprising a high-boiling organic solvent. The high-boiling organic solvent prevents the reaction liquid from drying. The following are preferred examples of the high-boiling organic solvent: polyhydric alcohols, which to some degree also overlap with the previously described polyols, such as ethylene glycol, diethylene glycol, triethylene glycol, polyethylene glycol, polypropylene glycol, propylene glycol, butylene glycol, 1,2,6-hexanetriol, thioglycol, hexylene glycol, glycerol, trimethylolethane, trimethylolpropane, and so forth; the alkyl ethers of polyhydric alcohols, such as ethylene glycol monoethyl ether, ethylene glycol monobutyl ether, diethylene glycol monomethyl ether, diethylene glycol monoethyl ether, diethylene glycol monobutyl ether, triethylene glycol monomethyl ether, triethylene glycol monoethyl ether, triethylene glycol monobutyl ether, and so forth; as well as urea, 2-pyrrolidone, N-methyl-2-pyrrolidone, 1,3-dimethyl-2-imidazolidinone, and triethanolamine.

While there are no particular limitations on the quantity of addition for the high-boiling organic solvent, approximately 0.5 to 40 wt % is preferred and approximately 2 to 20 wt % is more preferred.

The reaction liquid may also contain a low-boiling organic solvent in a preferred embodiment of the present invention. The following are preferred examples of this low-boiling organic solvent: methanol, ethanol, n-propyl alcohol, isopropyl alcohol, n-butanol, sec-butanol, tert-butanol, isobutanol, n-pentanol, and so forth. Monohydric alcohols are particularly preferred. This low-boiling organic solvent has the effect of shortening the ink drying time. The quantity of addition for the low-boiling organic solvent is desirably 0.5 to 10 wt % and more desirably is in the range of 1.5 to 6 wt %.

The reaction liquid may also contain a penetrant in a preferred embodiment of the present invention. This penetrant can be exemplified by various surfactants, e.g., anionic surfactants, cationic surfactants, and amphoteric surfactants, and by alcohols such as methanol, ethanol, isopropyl alcohol, and so forth, and by the lower alkyl ethers of polyhydric alcohols, such as ethylene glycol monomethyl ether, diethylene glycol monoethyl ether, diethylene glycol monobutyl ether, triethylene glycol monobutyl ether, propylene glycol monobutyl ether, dipropylene glycol monobutyl ether, and so forth.

Colorants as described below in the section on ink composition may be added to the reaction liquid into order to colorize same, thus yielding a reaction liquid that is also provided with the functionality of an ink composition.

The viscosity of the coating liquid (treatment liquid) is desirably in the range of 10 mPa·s to 200 mPa·s, while 10 mPa·s to 100 mPa·s is more preferred and 10 mPa·s to 50 mPa·s is particularly preferred.

The viscosity of the coating liquid can be adjusted into the preceding viscosity ranges according to, for example, the type and/or quantity of addition of the previously described high-boiling organic solvent and/or the addition of a water-soluble polymer.

The water-soluble polymer may be any water-soluble polymer. Gelatin, polyvinylpyrrolidone, polyethylene oxide, polyacrylic acid, polyacrylamide, polyvinyl alcohol, polysaccharide thickeners, and so forth, can be used, but polyacrylic acid, polyacrylamide, and polysaccharide thickeners are particularly preferred because they provide a large thickening effect at small quantities of addition. The molecular weight is desirably approximately 10,000 to 500,000.

Ink Examples

The ink used in the embodiments under consideration can be, for example, the known inks described in Japanese Patent Application Publication No. 2006-142665. Thus, introducing the description in Japanese Patent Application Publication No. 2006-142665 by citation thereof, the pigment in the pigment ink used in the embodiments under consideration is desirably used at 1 to 20 wt % and desirably 2 to 12 wt % as the weight ratio with respect to the total weight of the pigment ink. The black pigment can be exemplified by carbon black, for example, a carbon black as produced by the furnace method or channel method. The carbon black used desirably has the following characteristics: primary particle size=15 to 40 mμ (nm), specific surface area by the BET method=50 to 300 $m^2/g$, DBP oil absorption=40 to 150 ml/100 g, volatile fraction=0.5 to 10%, and pH=2 to 9. Commercial products that possess these characteristics can be exemplified by No. 2300, No. 900, MCF88, No. 33, No. 40, No. 45, No. 52, MA7, MA8, and No. 2200B (the preceding are products of Mitsubishi Chemical Corporation (former Mitsubishi Kasei Corporation)); Raven 1255 (product of Columbian Chemicals Company); Regal 400R, Regal 330R, Regal 660R, and Mogul L (the preceding are products of the Cabot Corporation); and Color Black FWI, Color Black FW18, Color Black S170, Color Black S150, Printex 35, and Printex U (the preceding are products of Evonik Degussa).

The yellow pigment can be exemplified by C.I. Pigment Yellow 1, C.I. Pigment Yellow 2, C.I. Pigment Yellow 3, C.I. Pigment Yellow 13, C.I. Pigment Yellow 16, C.I. Pigment Yellow 83, and so forth.

The magenta pigment can be exemplified by C.I. Pigment Red 5, C.I. Pigment Red 7, C.I. Pigment Red 12, C.I. Pigment Red 48(Ca), C.I. Pigment Red 48(Mn), C.I. Pigment Red 57(Ca), C.I. Pigment Red 112, C.I. Pigment Red 122, and so forth.

The cyan pigment can be exemplified by C.I. Pigment Blue 1, C.I. Pigment Blue 2, C.I. Pigment Blue 3, C.I. Pigment Blue 15:3, C.I. Pigment Blue 16, C.I. Pigment Blue 22, C.I. Vat Blue 4, C.I. Vat Blue 6, and so forth. In addition, newer pigments, such as self-dispersing pigments, can of course be used.

The pigment dispersant may be any water-soluble resin. However, the weight-average molecular weight is desirably 1,000 to 30,000 and more desirably is 3,000 to 15,000. The dispersant can be specifically exemplified by graft copolymers, random copolymers, and block copolymers comprising at least two monomers (wherein at least one thereof is a hydrophilic polymerizable monomer) selected from, for example, styrene, styrene derivatives, vinylnaphthalene, vinylnaphthalene derivatives, the aliphatic alcohol esters of α,β-ethylenically unsaturated carboxylic acids, acrylic acid, acrylic acid derivatives, maleic acid, maleic acid derivatives, itaconic acid, itaconic acid derivatives, fumaric acid, fumaric acid derivatives, vinyl acetate, vinylpyrrolidone, acrylamide, and derivatives of the preceding; the dispersant may also be a salt of these graft, random, and block copolymers. In addition, natural resins such as rosin, shellac, starch, and so forth, may also be used in a preferred embodiment. These resins are alkali-soluble resins that are soluble in aqueous solutions in which a base has been dissolved. The content of the hereinabove-described water-soluble resin used as a pigment dispersant is desirably 0.1 to 5 wt % with reference to the total weight of the pigment ink.

Pigment inks that contain a pigment as described above are desirably adjusted so that the pigment ink as a whole is neutral or alkali. This is done because it can improve the solubility of the water-soluble resin used as the pigment dispersant and can thereby provide a pigment ink that exhibits an even better long-term storage stability. However, since in this case there is a possibility of causing corrosion to the various members used in inkjet recording apparatuses, the adjustment is desirably carried out into the pH range of 7 to 10 where possible. The pH adjuster used here can be exemplified by various organic amines such as diethanolamine, triethanoamine, and so forth; inorganic alkali such as the alkali metal hydroxides, e.g., sodium hydroxide, lithium hydroxide, kalium hydroxide, and so forth; and organic acids and mineral acids. The aforementioned pigment and water-soluble resin functioning as the dispersant are dispersed or dissolved in a water-based liquid medium.

The water-based liquid medium used in the pigment ink in the embodiments under consideration is desirably a mixed solvent of water and a water-soluble organic solvent. In this case, ordinary water that contains various ions may not be used as the water, and ion-exchanged water (de-ionized water) is desirably used as the water.

The water-soluble organic solvent used in mixture with water can be exemplified by $C_{1-4}$ alkyl alcohols such as methyl alcohol, ethyl alcohol, n-propyl alcohol, isopropyl alcohol, n-butyl alcohol, sec-butyl alcohol, tert-butyl alcohol, and so forth; amides such as dimethylformamide, dimethylacetamide, and so forth; ketones and ketoalcohols such as acetone, diacetone alcohol, and so forth; ethers such as tetrahydrofuran, dioxane, and so forth; polyalkylene glycols such as polyethylene glycol, polypropylene glycol, and so forth; alkylene glycols in which the alkylene group has from 2 to 6 carbons, such as ethylene glycol, propylene glycol, butylene glycol, triethylene glycol, 1,2,6-hexanetriol, thiodiglycol, hexylene glycol, diethylene glycol, and so forth; glycerol; the lower alkyl ethers of polyhydric alcohols, e.g., ethylene glycol monomethyl (or ethyl) ether, diethylene glycol methyl (or ethyl) ether, triethylene glycol monomethyl (or ethyl) ether, and so forth; N-methyl-2-pyrrolidone, 2-pyrrolidone, 1,3-dimethyl-2-imidazolidinone, and so forth. Among this large population of water-soluble organic solvents, the use of the following is even more preferred: polyhydric alcohols such as diethylene glycol and so forth, and the lower alkyl ethers of polyhydric alcohols, e.g., triethylene glycol monomethyl (or ethyl) ether and so forth.

The content of the aforementioned water-soluble organic solvent in the pigment ink is generally 3 to 50 wt % of the total weight of the pigment ink and more desirably is in the range of 3 to 40 wt % of the total weight of the pigment ink. The water content is 10 to 90 wt % of the total weight of the pigment ink and is desirably 30 to 80 wt % of the pigment ink.

In addition to the components described above, surfactant, defoamer, preservative, and so forth, can be added on an optional basis to pigment ink usable in the embodiments under consideration in order to provide a pigment ink that exhibits desirable property values. In particular, the addition of a suitable quantity of surfactant that functions as a penetration promoter is strongly desired in order to bring about a rapid penetration by the liquid components of the pigment ink into the recording medium. The quantity of addition here is 0.05 to 10 wt % and more suitably is 0.5 to 5 wt %. With regard to examples of anionic surfactants, any anionic surfactant in general use is desirably employed, for example, carboxylate salt types, sulfate ester types, sulfonic acid salt types, phosphate ester types, and so forth.

The method of producing the hereinabove-described pigment ink begins with the addition with mixing and stirring of pigment as described above to an aqueous medium comprising at least water and the water-soluble resin that functions as a dispersant. This is followed by dispersion using a dispersion device as described below to obtain the desired dispersion, with the optional execution of a centrifugal separation treatment. Then, a sizing agent as well as appropriately selected additive components as described above are added to this dispersion, and it is stirred, resulting in obtaining the pigment ink.

When an alkali-soluble resin is used as the dispersant, a base must be added in order to dissolve the resin. Preferred examples of this base are organic amines such as monoethanolamine, diethanolamine, triethanolamine, methylpropanolamine (propanol methylamine), ammonia, and so forth, as well as inorganic bases such as potassium hydroxide, sodium hydroxide, and so forth.

It is effective in the production of pigment-containing pigment ink to carry out, prior to the dispersion process, a premixing step of at least 30 minutes in which the pigment-containing water-based medium is stirred. The reason for this is that this premixing process improves wetting properties of the pigment surface and promotes adsorption of the dispersant to the pigment surface.

The dispersing device used during the dispersion treatment of the aforementioned pigment may be any dispersing device in general use, for example, a ball mill, roll mill, sand mill, and so forth. The use is preferred thereamong of high-speed sand mills. Examples here are supermills, sand grinders, vis mills, agitator mills, grain mills, dyno mills, pearl mills, Coball mills, and so forth (all of the preceding are commercial names).

In order to prevent clogging of the ejection ports to the maximum extent possible in inkjet recording apparatuses that employ pigment inks, a pigment having an optimal particle size distribution is ordinarily selected for use. In this context, the following techniques, including combinations thereof, can be used to obtain a desired particle size distribution: reducing the size of the grinding media in the dispersing device, increasing the fill ratio of the grinding media, lengthening the treatment time, slowing the output speed, and post-grinding classification with, for example, a filter or centrifugal separator.

The inkjet recording apparatus 110 according to the hereinabove-described embodiments can uniformly apply a treatment liquid film in a required thickness of approximately several μm on a recording medium 112 as required and makes possible image recording at high image qualities.

The embodiments described above relate to examples of application to an inkjet recording apparatus for printing, but the scope of application of the present invention is not limited to this example. For instance, it can also be applied widely to other apparatuses which obtain various shapes and patterns by using a liquid functional material, such as a wiring printing apparatus which prints a wiring pattern for an electronic circuit, or a fine structure forming apparatus which forms a fine structure by using a material deposition substance.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid coating apparatus comprising:

a coating roller which has a coating surface applying a liquid onto a sheet-form medium;

a liquid holding unit which abuts against the coating surface of the coating roller so as to form a liquid holding space from which the liquid is fed to the coating surface;

a medium support member which faces the coating surface of the coating roller across the medium in such a manner that the medium support member and the coating roller nip and support the medium;

an abutment pressure-varying device which adjusts an abutment pressure exerted between the coating surface of the coating roller and the liquid holding unit; and a control device which is configured to control the abutment pressure-varying device according to a relative position of the medium with respect to the coating roller so as to adjust the abutment pressure in such a manner that: the abutment pressure is set to a first pressure value $P_A$ while the coating roller is rotating a prescribed time before a leading edge of the medium makes contact with the coating roller, the first pressure value $P_A$ being lower than a non-coating abutment pressure value $P_0$ exerted between the coating surface of the coating roller and the liquid holding unit while no coating is performed on the medium, and the abutment pressure is then set to a second pressure value $P_B$ while the liquid is applied onto the medium, the second pressure value $P_B$ being higher than the first pressure value $P_A$ and lower than the non-coating abutment pressure value $P_0$, wherein the coating roller rotates while the medium is sandwiched by the medium support member and the coating roller in such a manner that the liquid is fed to the coating surface from the liquid holding unit and the liquid is transferred to the medium from the coating surface.

2. The liquid coating apparatus as defined in claim 1, wherein the liquid holding unit has an abutment member which is formed from an elastic body and is disposed in a region of contact with the coating surface of the coating roller.

3. The liquid coating apparatus as defined in claim 1, wherein the abutment pressure-varying device has a movable mechanism that presses the liquid holding unit toward the coating surface of the coating roller.

4. The liquid coating apparatus as defined in claim 3, wherein the movable mechanism includes: an urging member that urges the liquid holding unit toward the coating surface of the coating roller; and a cam that changes an amount of deformation of the urging member.

5. The liquid coating apparatus as defined in claim 1, wherein the abutment pressure-varying device is a displacement device that is able to displace the coating roller in a direction corresponding to a direction in which the coating roller is separated from the medium, and in a direction corresponding to a direction in which the coating roller is pressed toward the medium.

6. The liquid coating apparatus as defined in claim 5, wherein when the displacement device displaces the coating roller in the direction corresponding to the direction in which the coating roller is separated from the medium, a pressing pressure between the coating roller and a coating roller-abutting downstream region of the liquid holding unit on a downstream side in terms of a direction in which the coating roller rotates is increased while a pressing pressure between the coating roller and a coating roller-abutting upstream region of the liquid holding unit on an upstream side in terms of the direction in which the coating roller rotates is reduced.

7. A liquid coating apparatus comprising:

a coating roller which has a coating surface applying a liquid onto a sheet-form medium;

a liquid holding unit which abuts against the coating surface of the coating roller so as to form a liquid holding space from which the liquid is fed to the coating surface;

a medium support member which faces the coating surface of the coating roller across the medium in such a manner that the medium support member and the coating roller nip and support the medium;

an abutment pressure-varying device which adjusts at least one of a first abutment pressure exerted between the coating surface of the coating roller and the liquid holding unit and a second abutment pressure exerted between the coating surface of the coating roller and the medium; and a control device which is configured to control the abutment pressure-varying device according to a relative position of the medium with respect to the coating roller so as to adjust the at least one of the first abutment pressure and the second abutment pressure, wherein the coating roller rotates while the medium is sandwiched by the medium support member and the coating roller in such a manner that the liquid is fed to the coating surface from the liquid holding unit and the liquid is transferred to the medium from the coating surface; and wherein the control device is configured to control the abutment pressure-varying device in such a manner that:

the first abutment pressure is set to a second pressure value until a second time before a trailing edge of the medium passes through the coating roller, during a time period when the liquid is applied onto the medium; and the first abutment pressure is set to a third pressure value higher than the second pressure value after the second time before the trailing edge of the medium passes through the coating roller.

8. A liquid coating apparatus comprising:

a coating roller which has a coating surface applying a liquid onto a sheet-form medium;

a liquid holding unit which abuts against the coating surface of the coating roller so as to form a liquid holding space from which the liquid is fed to the coating surface;

a medium support member which faces the coating surface of the coating roller across the medium in such a manner that the medium support member and the coating roller nip and support the medium;

an abutment pressure-varying device which adjusts at least one of a first abutment pressure exerted between the coating surface of the coating roller and the liquid holding unit and a second abutment pressure exerted between the coating surface of the coating roller and the medium; and a control device which is configured to control the abutment pressure-varying device according to a relative position of the medium with respect to the coating roller so as to adjust the at least one of the first abutment pressure and the second abutment pressure, wherein the coating roller rotates while the medium is sandwiched by the medium support member and the coating roller in such a manner that the liquid is fed to the coating surface from the liquid holding unit and the liquid is transferred to the medium from the coating surface; and wherein the control device is configured to control the abutment pressure-varying device in such a manner that:

the second abutment pressure is set to a fourth pressure value a third time before a leading edge of the medium makes contact with the coating roller; and the second abutment pressure is then set to a fifth pressure value lower than the fourth pressure value while the liquid is applied onto the medium.

9. A liquid coating apparatus comprising:

a coating roller which has a coating surface applying a liquid onto a sheet-form medium;

a liquid holding unit which abuts against the coating surface of the coating roller so as to form a liquid holding space from which the liquid is fed to the coating surface;

a medium support member which faces the coating surface of the coating roller across the medium in such a manner that the medium support member and the coating roller nip and support the medium;

an abutment pressure-varying device which adjusts at least one of a first abutment pressure exerted between the coating surface of the coating roller and the liquid holding unit and a second abutment pressure exerted between the coating surface of the coating roller and the medium; and a control device which is configured to control the abutment pressure-varying device according to a relative position of the medium with respect to the coating roller so as to adjust the at least one of the first abutment pressure and the second abutment pressure, wherein the coating roller rotates while the medium is sandwiched by the medium support member and the coating roller in such a manner that the liquid is fed to the coating surface from the liquid holding unit and the liquid is transferred to the medium from the coating surface; and wherein the control device is configured to control the abutment pressure-varying device in such a manner that:

the second abutment pressure is set to a fifth pressure value until a fourth time before a trailing edge of the medium passes through the coating roller, during a time period when the liquid is applied onto the medium; and the second abutment pressure is set to a sixth pressure value lower than the fifth pressure value after the forth time before the trailing edge of the medium passes through the coating roller.

10. The liquid coating apparatus as defined in claim 1, comprising a medium position detection device that detects a position of an edge of the medium that is to make contact with the coating surface of the coating roller.

11. An image forming apparatus comprising:

the liquid coating apparatus as defined in claim 1 applying a first liquid onto a medium; and a liquid ejection head which deposits a second liquid on the medium onto which the first liquid has been applied by the liquid coating apparatus.

12. The image forming apparatus as defined in claim 11, wherein the second liquid is an ink containing colorant, and the first liquid is an aggregating agent that has an ability to induce aggregation of the colorant.

* * * * *